US005924653A

United States Patent [19]

Pedersen et al.

[11] Patent Number: 5,924,653

[45] Date of Patent: Jul. 20, 1999

[54] TRAFFIC CONTROL SYSTEM AND METHOD OF CONTROLLING THE MOVEMENT OF A MOBILE UNIT

[76] Inventors: Heine Ewi Pedersen, Sydskraningen 1, Lyngby, Denmark, 2800; John Harder, Viborggade 8, st. th., Copenhagen Ø, Denmark, 2100; Flemming Lohmann-Jensen, Jensløvs Tværvej 13, 3th., Charlottenlund, Denmark, 2920

[21] Appl. No.: 08/809,565

[22] PCT Filed: Sep. 25, 1995

[86] PCT No.: PCT/DK95/00382

§ 371 Date: Jun. 6, 1997

§ 102(e) Date: Jun. 6, 1997

[87] PCT Pub. No.: WO96/09199

PCT Pub. Date: Mar. 28, 1996

[30] Foreign Application Priority Data

Sep. 23, 1994 [DK] Denmark ..... 1095/94

[51] Int. Cl.[6] ..... B61L 1/00

[52] U.S. Cl. ..... 246/167 R; 246/185; 246/187 C; 246/14; 246/8; 246/63 R; 246/194; 246/182 C

[58] Field of Search ..... 246/8, 14, 62, 246/63 R, 122 R, 123, 166, 167 R, 182 R, 182 B, 182 C, 194, 167 D, 185, 187 C

[56] References Cited

U.S. PATENT DOCUMENTS

| | | | |
|---|---|---|---|
| 2,641,688 | 6/1953 | Adams | 246/122 R |
| 3,888,437 | 6/1975 | Birkin | 246/63 R |
| 3,940,765 | 2/1976 | Grafinger et al. | 343/6.8 R |
| 4,697,179 | 9/1987 | Arimitsu et al. | 246/63 R |
| 4,735,383 | 4/1988 | Corrie | 246/122 R |
| 5,364,047 | 11/1994 | Petit et al. | 246/122 R |
| 5,398,894 | 3/1995 | Pascoe | 246/122 R |
| 5,487,516 | 1/1996 | Murata et al. | 246/182 C |

FOREIGN PATENT DOCUMENTS

| | | |
|---|---|---|
| 0 257 909 | 3/1988 | European Pat. Off. . |
| 3434268 | 3/1986 | Germany . |
| 1316561 | 5/1973 | United Kingdom . |
| WO89/00940 | 2/1989 | WIPO . |
| WO94/05536 | 3/1994 | WIPO . |

*Primary Examiner*—Mark T. Le
*Attorney, Agent, or Firm*—Jacobson, Price, Holman & Stern, PLLC

[57] ABSTRACT

A traffic control system for mobile units has a plurality of stationary, passive units having electronic store capacity and transmit and receive facilities. The store of the passive units contains an information code which is unique to the unit and is related to the position by a mobile unit, the stationary units supply their information code, enabling the mobile unit to calculate its position. The store of the stationary units, in addition to the information codes of the units, contains stored traffic messages which are supplied together with the information code upon interrogation from the mobile unit. The movement from the mobile unit can be adjusted according to the traffic information received.

10 Claims, 3 Drawing Sheets

TRAFFIC CONTROL SYSTEM AND METHOD OF CONTROLLING THE MOVEMENT OF A MOBILE UNIT

BACKGROUND OF THE INVENTION

1. Field of the Invention

The invention concerns a traffic control system and the use of such a system in connection with train traffic. The invention moreover concerns a method of controlling the movement of a mobile unit.

2. Description of the Related Art

The work on increasing train speeds has created a need for ensuring reliable train control systems.

EP-A-145 464 discloses a train control system wherein transponders, applying a coded response to an inquiry, are located along the track. A train receives information on the code of the next transponder from a control centre, and the train reports when this code has been detected. If the transponder is not detected, the train is brought to a standstill.

GB-A-2 219 833 discloses a traffic information system for use in bus traffic. A transmitter is provided at each bus stop, transmitting a code to a bus when interrogated, whereby the position of the bus may be determined. This information may be used e.g. in traffic control centres for putting on more buses if necessary.

U.S. Pat No. 5,129,605 discloses a system wherein a plurality of different position determination systems are used for determining the exact position of a train. The whole is controlled by a control centre which coordinates the information.

Furthermore, a safety system called automatic train control (ATC) has been developed for the purpose of improving train safety. This system protects against a number of human errors on the part of the train drivers, one of the basics of the system being that the train is provided with a computer which receives traffic information, such as stop signals and speed limits, from a plurality of transmitters along the track. Thus, the computer may bring the train to a standstill irrespective of what the train driver does when the train arrives at a stop signal. The signals and the transmitters are controlled from a central signalling post.

Finally, U.S. Pat. No. 3,940,765 discloses a traffic control system for trains, having a plurality of stationary passive units. This known system does not enable the trains to transmit messages to the stationary units.

The object of the invention is to provide a system making it possible to control a mobile unit, such as a train, which can take place without interference from a traffic control centre as long as the flow of traffic is smooth.

This object is achieved in that the traffic control system is provided with the constructive features of the present invention. The use of stationary, passive units arranged along a track obviates the need for running cables along the track. Thus, it is easy to encapsulate the stationary units so as to avoid ingress of water. The system is thus extremely insensitive to wind and weather. The stationary units apply a unique code to an interrogation, and the computer of a mobile unit can determine its position, the positions of the stationary units, following mounting, being determined exactly and stored electronically. The mobile unit can hereby determine its position on the basis of the unique code by an electronic look-up table. The mobile unit simultaneously receives traffic information, such as speed limits and data concerning the last-passed mobile unit, such as a train on the point concerned of the section, which supplies these data to the stationary units. It is hereby possible to control the speed pilot of the train by data obtained directly from the stationary unit. As mentioned, the traffic information may also include information concerning the last-passed train, it being hereby possible to estimate the distance to the preceding train and to determine the distance to it. The movement of the train or the mobile unit may thus be adjusted according to this information. This train control may be made additionally safe in that the trains automatically transmit the message to a central control unit, if they no longer keep an expected timetable, so that subsequent trains can calculate more safely whether the section ahead is unoccupied by combining data obtained from the stationary units with data concerning anomaly for a train ahead.

Expediently, the stationary units are tags which transmit and receive at frequencies, preferably at 27 MHz. The tags may hereby be buried and thus concealed and protected against wind and weather.

The stationary units are constructed to produce a very inexpensive and practically maintenance-free traffic control system, because the circuits are powered by the electromagnetic energy released by the mobile units through their interrogation signal.

Traffic messages may consist of the interrogation time of the mobile unit and identity information concerning the mobile unit. These data are communicated to the next unit and are then erased, since they are no longer of interest. The traffic messages may comprise speed limits and information on local conditions, and this information may be a warning of work along the track, etc.

The calculated position information may be displayed on a display, the information being represented either by numerical values or as a graphic indication on a map.

The control unit of the mobile unit calculates the distance to the last-passed mobile unit—optionally in time—which takes place on the basis of the received traffic messages from the stationary units and optionally from a traffic control centre if the last-passed unit does not keep a predetermined timetable.

Storage of driving-technical information expediently takes place while more permanent traffic messages are stored after the completion of a successful recognition procedure, i.e. a mobile unit is to validate that it is entitled to store the type of messages concerned, and such a procedure is usually called a handshaking procedure. Corresponding procedures are performed when such permanent traffic messages are erased.

The traffic control system may be used in connection with a large number of mobile units, and these follow a more or less predetermined route. This may e.g. be taxiing of aircraft in airports, where the pilot himself can taxi the aircraft to a gate, and the control tower does not have to interfere as long as there is no other aircraft along the route concerned. The system can be used in connection with public bus traffic, since a computer incorporated in a bus can transmit information to a traffic control centre if the bus does not keep the timetable. The traffic control centre can then display the expected changed arrivals at subsequent bus stops. The passengers will hereby be kept currently informed of the expected arrival of the next bus. However, the system finds particular application within traffic control systems in connection with railway traffic. Here, the train driver can drive the train without interference from the traffic control center as long as the established timetable is kept. The train drivers are no longer referred to visual signals along the track, but can drive the train on the basis of their knowledge of the position of the train and the knowledge of the position of the last-passed train. This opens up the prospect of introducing driver-less trains, where the computer of the train controls its movements.

The invention will be explained more fully below in connection with a preferred embodiment and with reference to the drawing, in which:

DETAILED DESCRIPTION OF THE PREFERRED EMBODIMENTS

Figure 1:
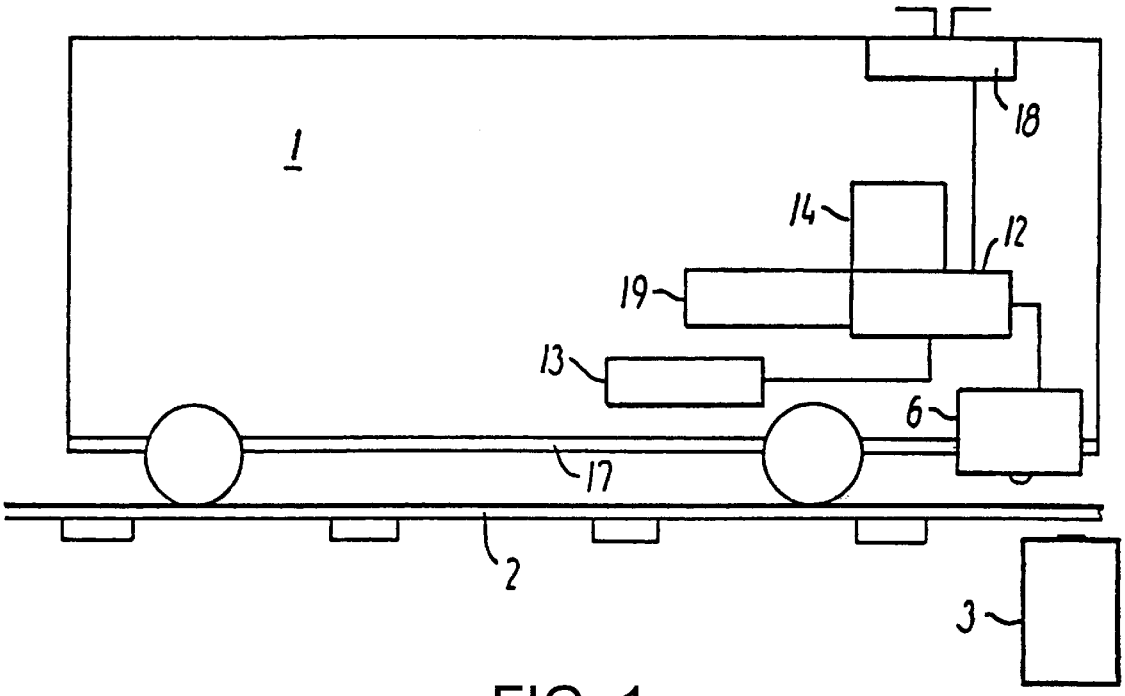
FIG. 1 schematically shows the control system of the invention in connection with a train.
Figure 2:
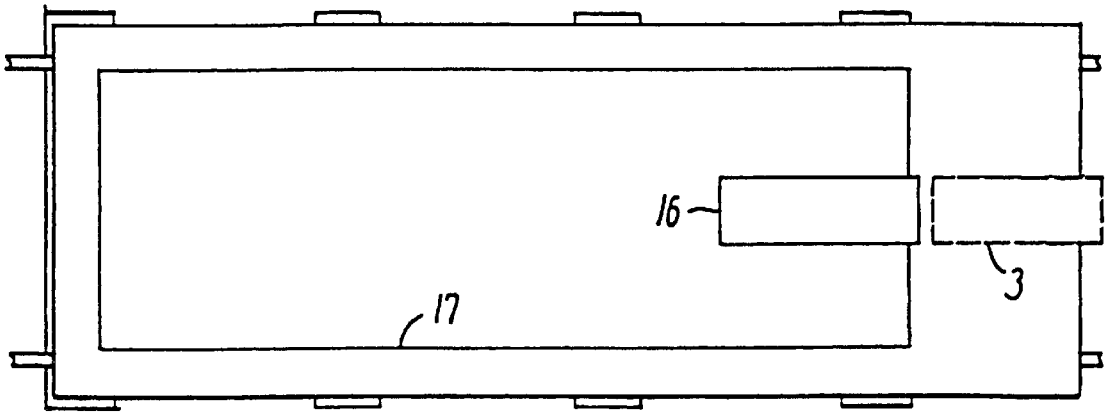
FIG. 2 shows in plan view how the control system of the train communicates with a stationary unit through an inductive coupling by means of frame aerial.
Figure 3:
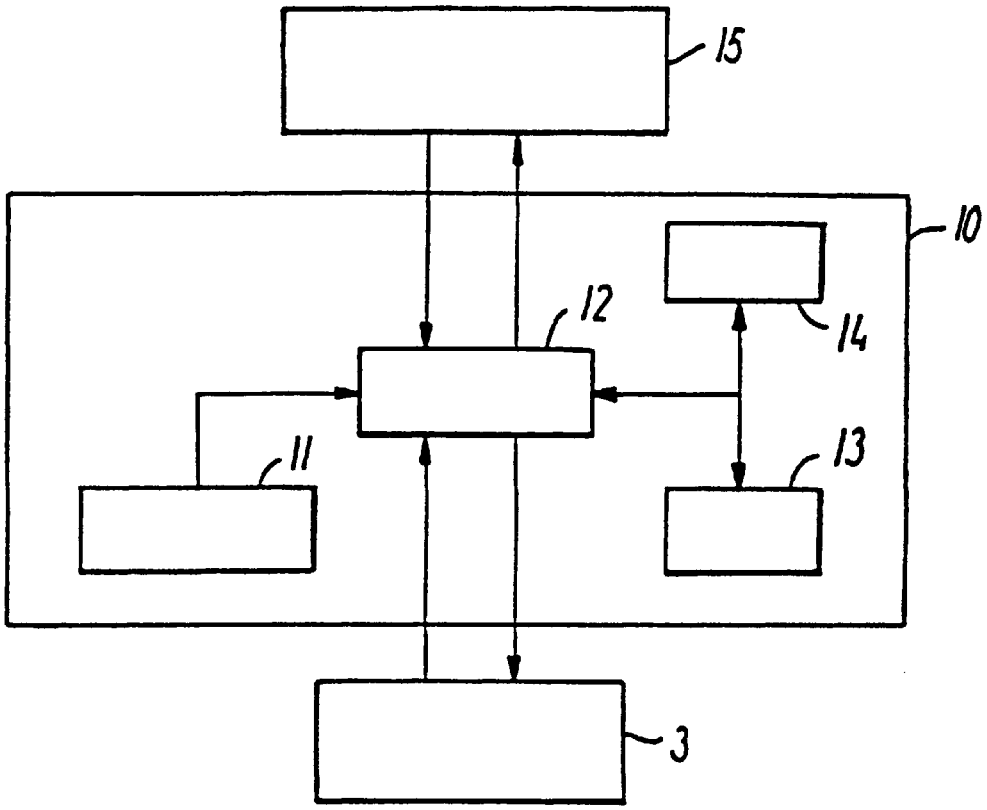
FIG. 3 schematically illustrates the communication between the computer of the locomotive and a stationary unit and a traffic control center.

The traffic control system of the invention is shown in FIG. 1 and is implemented in the shown embodiment in a train 1 travelling on rails 2. Stationary units 3 or tags are provided along the track, said tags preferably operating at 27 MHz, so that they lend themselves to being buried, e.g. along a track, without interfering with the transmission and reception conditions of these tags. The stationary units 3, which are shown in greater detail in FIG. 4, all contain a predetermined identification code. These stationary units are provided along the track at a predetermined distance of e.g. 100 meters or 500 meters, and the positions of the stationary units are subsequently determined very precisely, and the position of the unit is stored together with the information code as a table in an electronic store. These electronic tables are subsequently copied in the computers of all mobile units, which can subsequently determine their own positions exactly by a table look-up when they detect a stationary unit. The mobile unit 1 communicates with the stationary unit 3 through a frame aerial 17, which is connected to a computer 12 through a transmitter/receiver 16. This electromagnetic signal is received by a frame aerial 4 on the stationary unit, which will be explained in connection with FIG. 4. In reply to an interrogation the stationary unit transmits its identification code as well as stored traffic messages by means of which the computer 12 can calculate its own position and ensure that there are no other trains or mobile units immediately ahead on the rails. If the stationary unit 3 contains information concerning speed limits, such information may be used via the computer 12 for controlling the maximum speed of a traffic pilot 13. Further, the computer 12 can calculate the distance to the last-passed mobile unit, which can be shown on a display 14 together with various relevant items of information, such as the actual speed of the train, the time and the previously calculated position; the latter may be shown either in an alphanumeric representation or as a graphic representation on a map or a map segment. The train driver may also communicate with the computer 12 through a driver interface 19 in the form of a keyboard. The computer is moreover connected to a unit 11 from which driving-technical data are obtained. It is thus here that the computer receives information on the actual speed of the train. The computer 12 is finally connected to a unit 13 from which it receives information on driving-technical initiatives, i.e. activation of brakes, activation of throttle control, etc. It is noted that two-way communication is involved, so that the computer 12 receives information on driving-technical initiatives, but can also take over the control from the train driver, if, owing to the received information, the computer detects a situation where such interference is required.

Simultaneously, the computer 12 is in radio communication with a traffic control centre 15, which takes place via a transmitter/receiver 18 with associated aerial. The computer 12 currently receives relevant information via this radio connection, and this information comprises time adjustments, the passage points of time of the system being currently stored in the stationary units, so that a certain precision is required with respect to the points of time. The information also comprises current information on other trains, if these do not keep the predetermined timetables, and the amount of deviation involved for these trains timewise. Trains are identified by means of predetermined identification codes. The center simultaneously transmits current interrogations to which the computer merely replies OK as long as the timetable is kept. In case of deviations from the timetable beyond permitted tolerances, the computer of the train communicates the amount of these deviations, which is determined by means of the position determination compared with predetermined timetables stored in the store of the computer.

Figure 4:
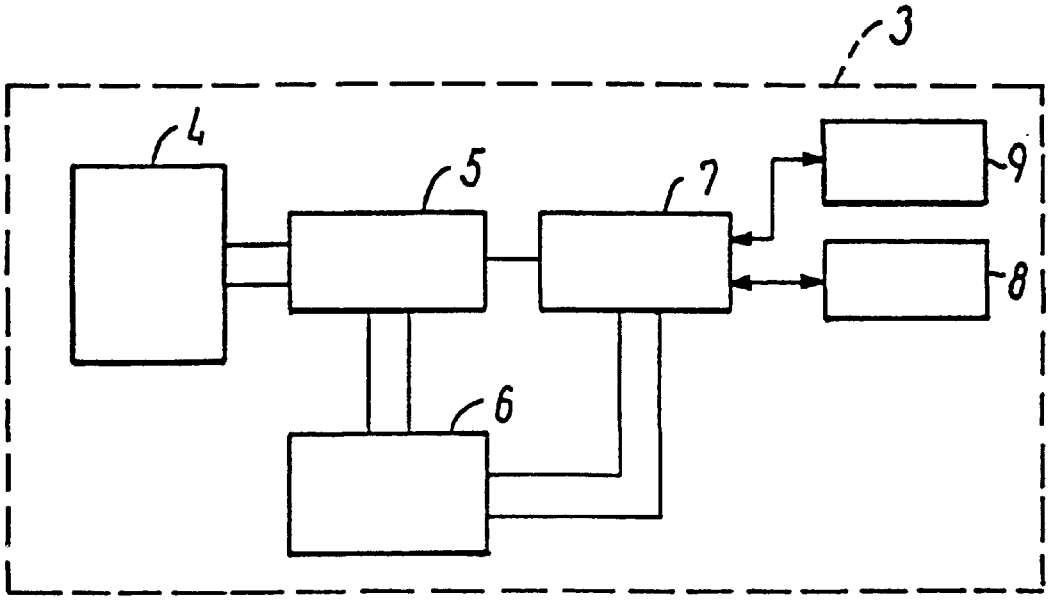
FIG. 4 schematically shows the structure of a stationary unit.

FIG. 4 shows the stationary unit 3 which, as mentioned before, comprises a frame aerial 4 or coil, which communicates with the control unit 7 or CPU of the stationary unit via a transmitter/receiver interface 5. The control unit 7 is powered from the transmitter/receiver interface, which takes place by means of a rectifier circuit 6 that rectifies the radio signal and supplies a DC voltage to the control unit 7 over its associated stores. The control unit 7 has a PROM 9 in which the program sequences necessary for the function are stored together with the unique identification code of the control unit. The stationary unit moreover has a RAM in which traffic messages are stored. Traffic messages in the form of passage points of time or interrogation points of time and train information are overwritten on previous, corresponding information, while traffic messages of a more permanent nature, such as speed limits and the like, are stored in separate store sections in the RAM 8.

Figure 5:
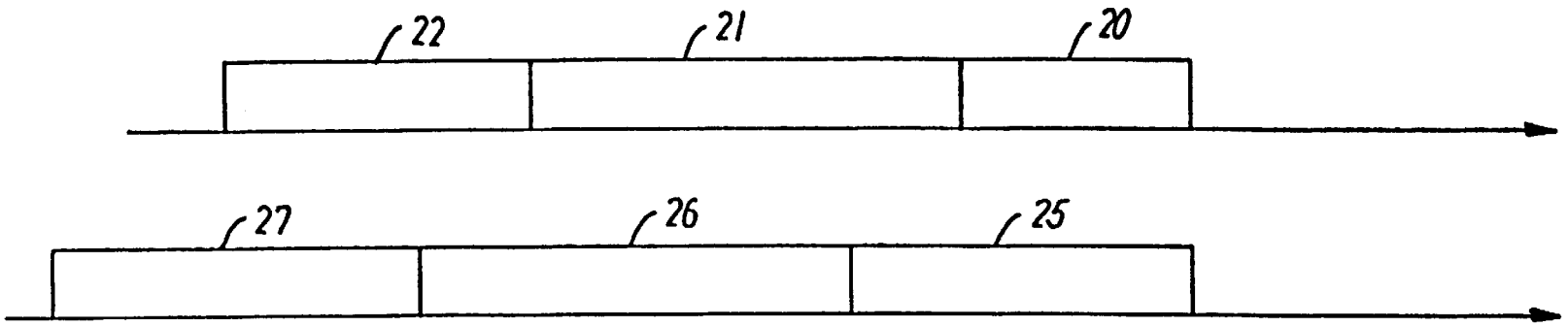
FIG. 5 shows how the information may be protocolized with an interrogation and a subsequent reply in a traffic control system according to the invention.

The communication between a mobile unit 1 and a stationary unit 3 may take place e.g. as shown in FIG. 5. The mobile unit first gives a password 20 which partly ensures that the unit is allowed to store data in the RAM of the stationary unit, partly starts the power supply to the stationary unit. After the password 20, an information code 21 is given, followed by driving-technical information 22 in the form of interrogation point of time and optionally speed. When the stationary unit has received these data, it transmits its unique information code 25 by means of which the mobile unit can determine its position by a table look-up. It subsequently transmits traffic messages consisting partly of information on the last-passed mobile unit, said information being designated 26, as well as information of a more permanent nature, such as speed limits and warnings of work along the track. The last-mentioned permanent data are designated 27.

Figure 6:
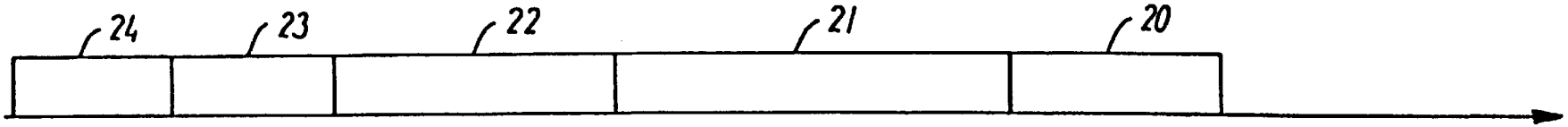
FIG. 6 shows how the interrogation may be designed, when simultaneously storing data of a more permanent nature.

FIG. 6 illustrates how data may be composed, if the mobile unit is to be permitted to store data which are of a more permanent nature. The data order is by and large the same as above, the mobile unit supplying a password 20, an identification code 21 followed by driving-technical data 22, and then the mobile units supply another password 23 which, if the stationary unit recognizes it, permits the mobile unit to store information of a more permanent nature, said information being designated 24 and comprising speed limits and the like, as mentioned above. When the stationary unit has recognized these data, it supplies a reply, as shown in connection with FIG. 5.

The invention has been explained above in connection with train control systems, but it is clear that a number of advantages can be achieved by implementing a system of the type described above along the roads in major Danish towns, where the knowledge of the exact positions of cars and buses may be used for improving the service to bus passengers, improving the safety of taxi drivers and aiding emergency vehicles by creating green waves through the towns.

The invention may moreover be used in connection with taxiing of aircraft in airports, so that the control towers are relieved of this type of job.

Further, the system opens up the prospect of putting driver-less trains into operation.

What is claimed is:

1. A traffic control system for mobile units comprising:

a plurality of passive stationary units having an electronic storage and a transmitter/receiver unit, each of said electronic storage containing an information code which is unique to the stationary unit and is related to the position of the stationary unit, said electronic storage storing traffic messages supplied thereto by at least one mobile unit;

at least one mobile unit having a computer with an associated electronic storage and having a transmitter/receiver unit for interrogating said stationary units to receive the information code and any traffic messages stored in said stationary unit, for determining a position of said mobile unit based upon the received information code, for adjusting movement of the mobile unit in response to the received traffic messages, and for transmitting traffic messages to said stationary units; and said stationary units further including a control unit for recording traffic messages received from the mobile units and stores the received traffic messages in an electronic memory and subsequently transmitting the received traffic messages to one or more successively interrogating mobile units.

2. A traffic control system according to claim 1, wherein the passive units are tags which transmit and receive at frequencies.

3. A traffic control system according to claim 1, the transmitter and receiver of the passive stationary units each comprise a passive, inductive coil over which the interrogation signal is received and a response signal, with the information code and traffic messages, is supplied, and the stationary units further comprise and integrated electronic circuit having a ROM for storing the information code and a RAM for storing the traffic messages, and that the electronic circuit is powered with energy collected by the inductive coil.

4. A traffic control system according to claim 1, wherein the traffic messages comprise an interrogation point of time and identity information concerning the interrogating mobile unit.

5. A traffic control system according to claim 1, wherein the traffic messages contain information on speed limits and information on local conditions.

6. A traffic control system according to claim 1, wherein the mobile units have a control unit which, by a lookup in a catalog stored in the electronic storage associated with the computer, determines the position of the unit in response to the information code received from one of said stationary units, and that the control unit has an associated display to display the position.

7. A traffic control system according to claim 6, the control unit further comprising a calculating unit which calculates the distance to the last-passed mobile unit in response to the received traffic messages and messages from a traffic control center, if the movement of the last-passed unit differs from a predetermined timetable, and that this distance is displayed by the display.

8. A traffic control system according to claim 1, wherein the control units of the stationary units store traffic messages concerning the movement of a mobile unit in a section of the electronic memory in which corresponding information on a last-passed mobile unit was stored.

9. A traffic control system according to claim 1, wherein the control units of the stationary units store traffic messages of a permanent nature in a ROM, and that these messages are stored only after completion of a successful recognition procedure.

10. A method of controlling the movement of a mobile unit comprising:

storing, at a plurality of passive stationary units, a unique identification code, interrogating, by the mobile unit, one of the plurality of passive stationary units, transmitting, from the stationary unit in response to the step of interrogating, the stored information code to the mobile unit, receiving, at the mobile unit, the unique identification code and determining the position of the mobile unit in response to the received unique information code, storing, at the stationary unit, traffic information from at least one previously interrogating mobile unit, receiving, at the mobile unit, the stored traffic information from the stationary unit, and controlling the movement of the mobile unit in response to the determined position and the received traffic information.

* * * * *